United States Patent [19]

Grotnes, II

[11] 4,389,875

[45] Jun. 28, 1983

[54] METHOD AND APPARATUS FOR MAKING BEADS ON DRUMS

[75] Inventor: Carl C. Grotnes, II, Roswell, Ga.

[73] Assignee: Atlanta Grotnes Machine Company, Atlanta, Ga.

[21] Appl. No.: 220,708

[22] Filed: Dec. 29, 1980

[51] Int. Cl.[3] ..... B21D 17/02; B21D 15/06

[52] U.S. Cl. ..... 72/393; 72/22; 72/27

[58] Field of Search ..... 72/355, 393, 441, 392, 72/22, 23, 27, 125; 74/44, 411.5

[56] References Cited

U.S. PATENT DOCUMENTS

| | | | |
|---|---|---|---|
| 2,037,247 | 4/1936 | Lindgren | 72/393 |
| 2,089,475 | 8/1937 | Grotnes | 72/393 |
| 2,720,241 | 10/1955 | Calcaterra | 72/393 |
| 2,774,406 | 12/1956 | McCoy | 72/393 |
| 3,098,518 | 7/1963 | Calcaterra | 72/392 |
| 4,037,458 | 7/1977 | Sato | 72/441 |
| 4,198,844 | 4/1980 | Lowe et al. | 72/393 |

FOREIGN PATENT DOCUMENTS

| | | | |
|---|---|---|---|
| 964804 | 7/1964 | United Kingdom | 72/393 |
| 404529 | 10/1973 | U.S.S.R. | 72/393 |

*Primary Examiner*—Lowell A. Larson
*Attorney, Agent, or Firm*—Patrick F. Henry

[57] ABSTRACT

The present machine, sometimes known as a beader or drum beader, receives a steel drum in a horizontal position and expands circumferential beads into the body to provide structural strength. A pair of opposed heads which reciprocate in and out of the drum body are driven respectively by means of a crank arrangement comprising a connecting rod which is fixed with a pivoting joint on the back of the head. The other end of the connecting rod is attached to gear by a pin which is offset from its center axis. Each head travels horizontally on a frame of the machine into and out of a drum which is placed thereon. A hydraulic cylinder provides the expansion of the dies on the head which are used to engage the drum and form the beads. Thus, the operation of the connecting rod is mechanical but the dies are operated by hydraulic cylinder in the head and when the proper stroke is reached that corresponds to the correct height of the bead the cylinder retracts the bead dies. The connecting rod is driven by a motor through a clutch which transmits power to the gear and a brake is signaled electrically to stop the crank.

28 Claims, 6 Drawing Figures

METHOD AND APPARATUS FOR MAKING BEADS ON DRUMS

BACKGROUND OF THE INVENTION

1. Field of the Invention

Machines for making or forming beads on steel drums by inserting expandable dies in each end of the drum and removing same after the bead is formed, sometimes known as bead forming machines or just beaders.

2. Description of Prior Machines and Methods

The No. 812 bead expander produced by Atlanta Grotnes Machine Company of 300 Selig Drive, S. W., Atlanta, Ga., 30336, may be characterized as primarily a mechanical apparatus for forming the beads or rolling hoops into a steel drum. The machine is a horizontal type which means that the heads with the expanding dies for forming the bead traveling in and out of the open end of the drum positioned between the opposed heads. The drive mechanism for each head comprises a large gear at a respective end of the machine which is operated through a series of beveled gears and a common drive shaft by means of an air clutch. Each gear has a pin located off-center from the central axis of the gear which pin is a crank pin or pivot for a connecting rod and which is located at the other end of the head. Each drawbar operates a cone which is used to expand the dies for beading. Each head must be stopped in its travel into the drum when the position of the bead die is correct in its location from the end of the drum. This is accomplished by stop rods which physically restrain the head from moving forward any further during the stroke of the drawbar. The drawbar not having reached a full stroke position continues forward and when the head stops the drawbar travels into the bead die expanding it into the drum and forming the bead. The further the drawbar moves into the dies the higher the bead will be. The drawbar comes to a stop in its forward motion and begins to retract as the gear continues to rotate. The cone is retracted out of the dies first and then the head itself is retracted by the drawbar. The cycle is completed when the head is totally out of the drum body and in its extreme return or back position. At this time the clutch is deenergized and a brake is applied. There is quite a lot of mechanical shock each time a bead is formed.

The No. 203 bead expander produced by Atlanta Grotnes Machine Company may be characterized essentially or primarily as an all hydraulic beader. In the place of the mechanical drive, drawbar and crank system mentioned previously in connection with the No. 812 bead expander, the No. 203 bead expander utilizes hydraulic cylinders which stroke out to push each head to its correct position with respect to the bead dies in relation to the drum. Stops are used to limit the stroke of the cylinder. When the heads are in correct position other hydraulic cylinders, one in each head, stroke out to expand the bead dies into the drum body. Each cylinder rod carries a cone which pushes the dies to expand or contract same. After the proper stroke is reached and the height of the bead is acquired, the cylinders shift directions and retract the cones. Thus, although there are some mechanical parts the formation of the beads is primarily hydraulic as contrasted with the previous machine No. 812 which is primarily mechanical.

The hydraulic machines such as the No. 203 are easier to adjust for changes in bead height and bead center than the mechanical machines such as No. 812 because the movement of the head and the expanding mechanism are separate. However, a mechanical machine because of its mechanical drive system can be cycled at a higher speed than a hydraulic machine and a mechanical drive produces a known controlled motion whereas a hydraulic machine relies on a cylinder that often can be erratic in its motion but there is a lot of shock in the mechanical systems. Also, in the hydraulic machines the motion is dependent upon too many variables such as pressure, temperature of hydraulic fluid and length of stroke needed. The present machine combines and utilizes the advantage of the mechanical drive of a mechanical machine with the independence of head movement and expansion of the hydraulic machine timed and synchronized electrically by means of limit switches (LS). An important feature of the new machine arises from a combination of advantages of the use of an independent mechanical drive for stroking the heads in and out of a smooth and controlled motion (sometimes called harmonic motion) providing a smooth and uniform change in acceleration as a head starts from a resting position through a uniform deceleraton to its next resting position. All of this occurs while drive gears are at a constant rpm. The clutch and brake are engaged as the head passes through these areas of near zero speed and because of this the shock loads, found in some prior machines, such as the No. 812 or the No. 203, are eliminated. Thus, the present machine may be lighter with potentially a longer life through the elimination of some of the heavy shock forces. This feature alone makes the present machine a substantial improvement over the previous machines.

SUMMARY OF THE INVENTION

The present machine employs the usual machine base with opposed heads that are movable from opposite ends of the machine into and out of an open drum body from each respective end thereof, and each head contains a hydraulic cylinder which provides the force for expanding the conventional set of dies in a direction radially outwardly through the means of forcing a cone through the center of the dies whereby the dies move outwardly into the body of the drum and form the metal into a bead or hoop. Each head is independent of the other and is moved by means of a connecting rod which is fixed with a pivoting joint on the back of the head. The other end of the connecting rod is attached to a gear by a crank pin which is offset from the center axis of the gear which travels 360 degrees whereby the gear is in effect a crank with a throw equal to twice the offset of the pin to gear centerline. The gear is driven from a motor by means of a clutch.

A primary advantage of the present machine is the combination of hydraulic and mechanical particularly with respect to the use of a mechanical drive with the independence of the hydraulic expansion of the means for forming the beads on each head.

An important feature of the new machine is found in the combination of the use of an independent mechanical drive for stroking the heads in and out in a harmonic motion thereby providing a smooth and uniform change in acceleration which occurs while drive gears are at a constant rmp.

Other and further objects and advantages of the present method and apparatus will become apparent upon reading the following description of a preferred embodiment in conjunction with the accompanying drawings.

DESCRIPTION OF A PREFERRED EMBODIMENT

Figure 6:
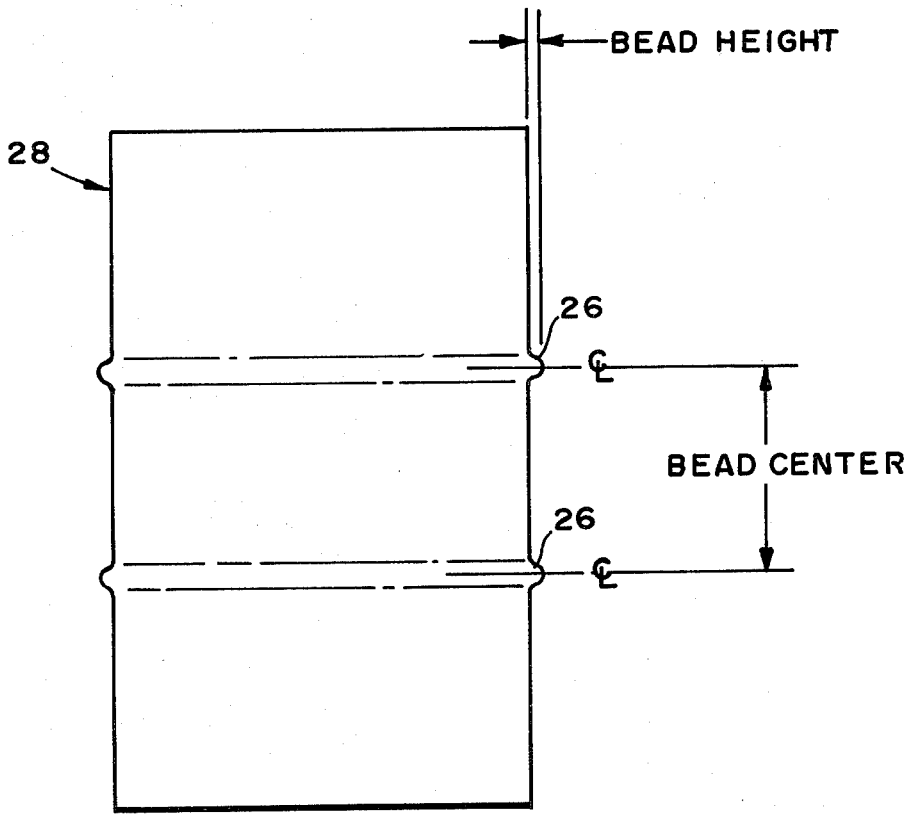
FIG. 6 is a diagrammatic view of a drum having typical beads formed thereon.

The machine 10 comprises a rigid machine frame 12 having bottom support feet 14, heavy side plates 16 and heavy end plates 18. Machine 10 is substantially symmetrical about a vertical center line through the middle and comprises opposed bead-forming heads 20 mounted on the machine frame 12 in spaced, opposed relationship for the purpose of entering the inside of a drum initially positioned between the heads to receive a circumferential bead from the inside of the drum toward the outside of the drum in the manner of the prior machines such as the previously mentioned No. 203 and No. 812 machines produced by Atlanta Grotnes Machine Company. The operation and activity of the formation of the beads through the bead-forming means in each head 20 per se is not significantly different from that performed in the prior machines. Each head 20 has a horn 21 and outside die table 22 supporting on a holder assembly 23 a plurality of circumferentially arranged bead die members 24 which are movably mounted on the heads 20 in conventional fashion for radial outward displacement to engage and form beads 26 on interior of a drum 28 to force the metal of the drum outwardly to form beads 26 in the manner shown in the illustration in FIG. 6.

The bead die members 24 are driven outwardly simultaneously by means of a bead die cone 30 mounted within each respective head 20 on one end 31 of a piston rod 32 of a hydraulic cylinder 34 having a hydraulic cylinder stroke adjustment means 35 comprising a stop nut 36 thereon for adjusting the travel of the cone 30 to engage the bead die members 24 thereby governing the exact moment at which the bead die members 24 are expanded into the interior of the drum 28. The other end 37 of rod 32 projects from cylinder 34 and nut 36 is threaded thereon to engage a stop block member 38 mounted on the head 20. Nut 36 controls the maximum movement of rod end 37 by contacting the block 38 and provides an adjustment to the rod 32 and therefore of the cone 30 thereon adjusting the bead die members 24. The hydraulic cylinder 34 is carried by a vertical plate arrangement 39 which carries a cylindrical housing 40 supported on side plate members 42 which form part of the heads 20. There is a die table spacer 44 mounted on the outside die table 22 which is part of a die holder 46 and assembly 23.

Each head 20 is caused individually and respectively to reciprocate on respective side rail 48 on the machine frame 12 and to move in a horizontal direction toward and away from each other into and out of a drum 28 placed in a drum cradle 50 having a drum lift adjustment support 52 on which is mounted a cylinder lift cradle bracket 54 having a cradle cylinder mount 56 supporting a cylinder 58. Each head 20 is respectively and independently driven by a respective connecting rod 62 rigidly attached to a crank arm 64 by means of a connecting shaft 66 having an adjustment wheel 68 mounted thereon and being threaded on opposite ends and having reverse thread arrangement with the internal threads in the respective connecting rod 62 and the connecting shaft 66 whereby turning the wheel in one direction or the other will adjust the connecting rod 62 by adjusting the position of the respective head 20 to which the respective connecting rod 62 and connecting shaft 66 is attached by means of a pin 69 attaching the crank arm 64 to the plate 38 on head 20.

The end of the connecting rod 62 opposite from the connecting shaft 66 is attached to a large bull drive gear 72 by means of a crank pin 74 and the bull gear 72 on a shaft 75 is driven from pinion gears 76 mounted on a drive shaft 78 which is attached to a clutch 80 of the sort sold under the name "Minster" (trademark) such as a "CFC" with flywheel. Clutch 80 is driven by a series of V-belts 82 from an electric motor 84 having an output pulley 86 thereon. Motor 84 is mounted on a motor mount 88 attached to the top of a housing 90 which has the bull gear 72 located within and has an open end from which is driven the connecting rod 62.

The motor pulley 86, the V-belts 82 and the clutch 80 are covered by an open drive guard 92.

A pilot ring stop 96 comprises a pilot ring 98 which provides a centering device for a drum 28 which if not centered is relocated by the ring stop 96 when the head 20 moves into position in the drum 28.

Figure 2:
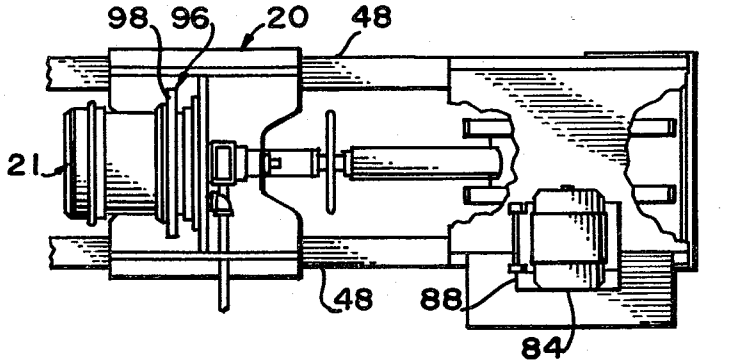
FIG. 2 is a top plan view of the portion of the machine which is shown in full lines on the right hand side of the machine in FIG. 1.
Figure 3:
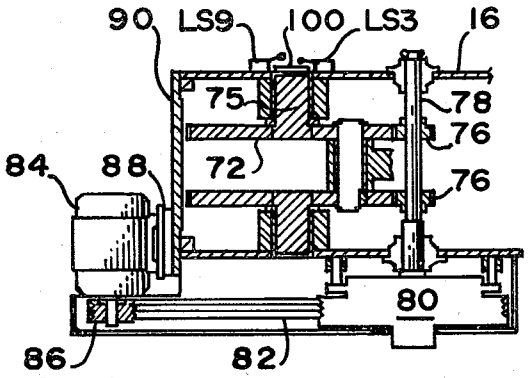
FIG. 3 is a vertical cross-sectional view taken substantially along lines 3—3 in FIG. 1 with the large gear rotated 90° and the motor in full lines.
Figure 1:
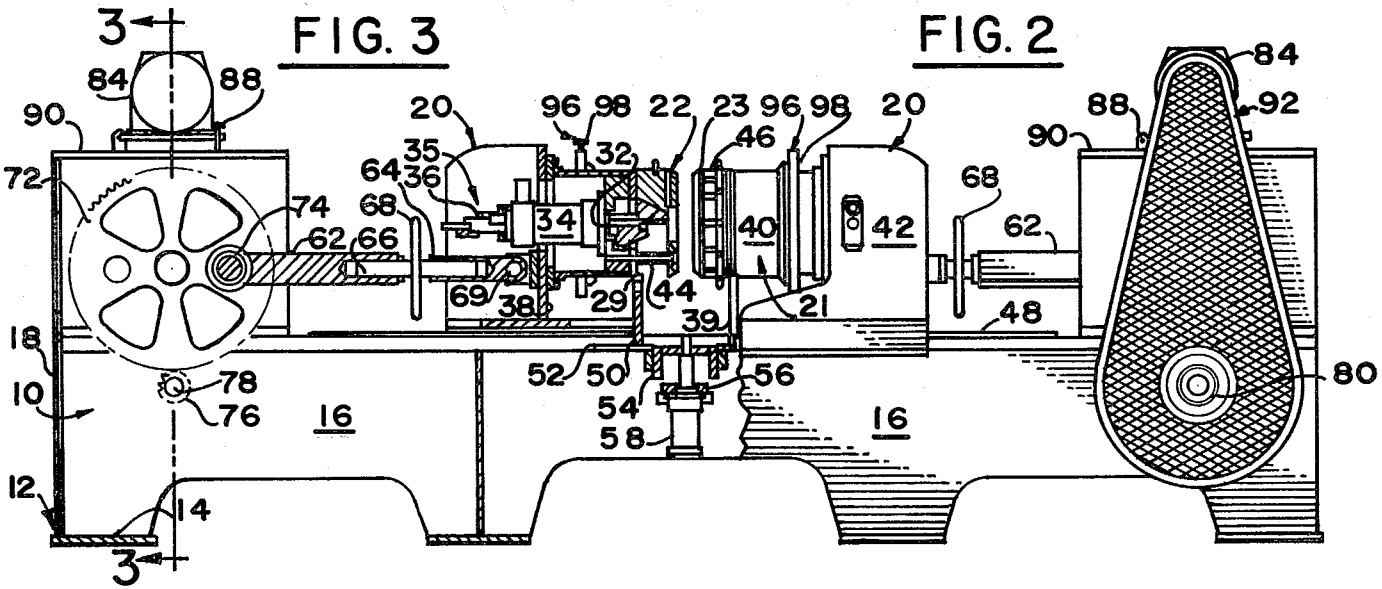
FIG. 1 is a side elevation view of the machine of the present invention with portions thereof broken away to show internal details.
Figure 4:
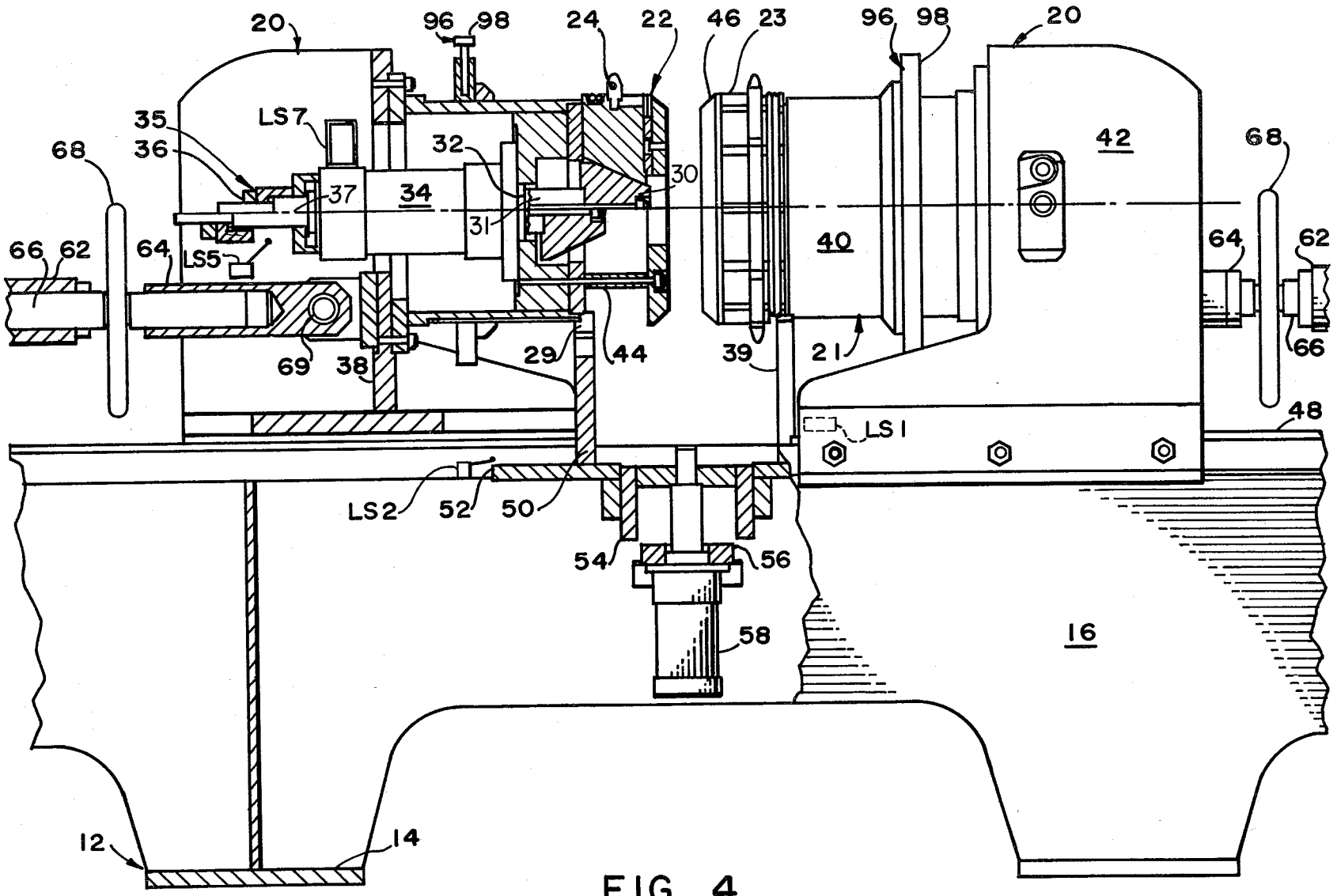
FIG. 4 is an enlarged view of a portion of the machine in FIG. 1.
Figure 5:
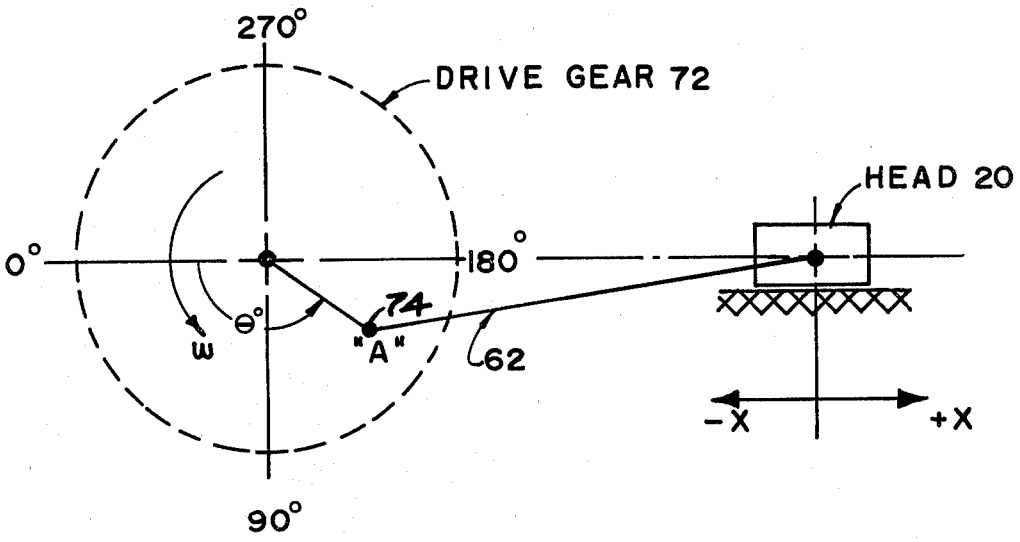
FIG. 5 is a diagrammatic view illustrating the movement of the drive gear and the motion transferred to the head which reciprocates in a harmonic motion.

The heads 20 are driven in and out of a drum 28 with a smooth and controlled motion called harmonic motion and this type of motion when applied to the heads 20 gives a smooth uniform change in acceleration as the heads 20 start from resting position and then a smooth uniform deceleration to the next resting position. This occurs while the pinion gears 76 are at a constant rpm. As the drive gears 76 rotate at a constant rpm (as indicated by the diagrammatic illustration in FIG. 5) the motion of the bull drive gear 72 is transferred to each head 20 which reciprocates in a harmonic motion. As point A nears 0° and 180° the head 20 smoothly accelerates to a stop. Thus, the present machine combines the advantages of the all mechanical drive of the previous mechanical machines with the independence of head movement and expanding of the bead forming means which is found in the hydraulic machines.

The clutch 80 includes a brake means which is engaged as the heads 20 pass through the areas of near zero speed. Because of this the shock loads which are found in the other machine such as the two previous machines mentioned herein are virtually eliminated. This makes it possible to build a lighter machine that potentially has a longer life due to the elimination of heavy shock forces. This feature alone makes the present machine a significant improvement over the other machines mentioned herein and furthermore the ease of adjustability makes it even more desirable.

The machine 10 operates in the same manner as previous machines, to wit:

1. The drum 28 is loaded into the center of the machine 10 between the two heads 20.

2. The heads 20 travel into the drum 28 from both ends by means of the drive gear 72 driving the respective connecting rod 62 and crank arm 64 in the smooth and harmonic motion mentioned previously.

3. Each cylinder 34 strokes out at the proper moment to expand the bead die members 24 at the correct position in relation to the inside of the drum 28 and the exact position is readily adjusted by means of the hydraulic cylinder stroke adjustment 35 on each hydraulic cylinder 34. Each cone 30 is driven at the proper instant to expand the bead die members 24 into the interior of the drum. This is performed substantially at the point of maximum stroke of the connecting rod 62 and crank arm 64 so that there is a hesitation of the head and therefore the bead die members just at the point of actuating the bead die members 24 into engagement with the interior of the drum 28 at which time after the bead die members 24 are retracted from drum 28 by cylinder 34 and cone 30 the direction of the heads 20 is immediately reversed and there is no shock which has occurred previously in the other types of machines.

The head 20 drive and the hydraulic cylinder 34 and the operation of the cone 30 are independent but are timed and synchronized and operated by means of an electrical circuit and controls such as limit switches (LS). To cycle the machine the following sequence is performed: As a drum 28 enters the machine a limit switch LS1 adjacent cradle 50 is actuated by the drum 28. LS1 signals the cradle 50 to lift the drum. When the cradle 50 is up it actuates a respective limit switch LS2 which signals the respective clutch 80 to engage which starts driving the two heads 20 in toward each other. The heads 20 stop when each one reaches its full stroke in. This is accomplished by disengaging the clutch 80 and engaging the brake at each head drive. The signal for this is the actuation of a limit switch LS3 located next to the shaft for the main drive gear, one LS3 for each head. An actuator 100 is mounted to each shaft 75 and these trip LS3 as the shaft 75 turns. (one actuation every 360°). The same signals that stop each head 20 also shifts the hydraulic valves that control the hydraulic cylinders 34 of their respective heads 20. With the hydraulic valves shifted, the cylinders 34 stroke out to expand a bead. Each cylinder 34 has a limit switch LS5 at the back of the cylinder. As the cylinder 34 strokes the cone out to expand the beads 36 the other rod at the back of the cylinder 34 strokes in. On this rod 32 are stop nuts 36 which actuate the limit switches LS5 at the back of each cylinder 34. The respective switch LS5 when actuated signals the hydraulic valves to shift back to their original position and therefore change the direction of stroke for their corresponding cylinders 34. When each cylinder 34 has retracted completely, limit switch LS7, which is built into the cylinders 34, senses the end of the stroke. The signal from each limit switch LS7 signals the clutch 80 for its corresponding head drive 62 etc. to be engaged once more to return the head 20 to its original position. Limit switches LS9 respectively located at each drive gear 72 act similarly to LS3. They are tripped when the heads 20 have reached their extreme out position. This actuation of the limit switches LS 9 disengages the clutches 80 and reengages the brakes, thus ending a complete cycle for the machine.

While I have shown and described a particular embodiment of this machine together with a suggested mode of operation thereof, this is by way of illustration and description of a preferred embodiment and does not constitute any limitation on the scope of the invention since there are various alterations, changes, deviations, revisions, departures and amendments which may be made in the present machine without departing from the scope of this invention as defined in the appended claims.

What is claimed is:

1. In a machine for forming a bead on a drum:

a machine frame, opposed heads mounted for movement on said machine frame toward and away from each other, bead forming means on each of said heads for movement thereon to engage the interior of a drum and to form a bead circumferentially thereon, said bead forming means being independently operable on each of said heads to engage said drum to form a bead thereon, crank means on each of said heads for driving said respective head in and out of said drum, said crank means being actuated independently of said bead forming means, drive means for said crank means, said drive means and said crank means being operated independently of said bead forming means whereby said crank means drives said heads in a smooth motion independently of said bead forming means, bead forming drive means independent of said drive means for said crank means, brake means for stopping said crank means and said drive means for said crank means to cause said heads to pause inside said drums, means for timing said crank means and said crank drive means to synchronize with said bead forming means so that said opposed heads pause inside said drum while said bead forming means form beads during which said bead forming means is operated independently of said crank means and crank drive means whereby said bead forming means is not driven by or from said crank drive means or said crank means.

2. The machine claimed in claim 1 wherein said crank means comprises a connecting rod, a gear having said connecting rod pivotally attached thereto at a position away from the center thereof.

3. The machine claimed in claim 2 wherein said crank means also includes a crank arm attached to said connecting rod, said crank arm being adjustable whereby the stroke of said head may be adjusted.

4. The device claimed in claim 1 wherein said drive means comprising: a connecting rod and a large gear, a smaller gear driving said large gear, clutch and brake means, and motor means for driving said clutch and brake means.

5. The machine claimed in claim 4 wherein said bead forming means comprises a hydraulic cylinder and piston.

6. The machine claimed in claim 5 wherein said bead forming means comprises a cone driven by said hydraulic cylinder to expand and retract said bead forming members.

7. The device in claim 1 wherein said bead forming means is actuated by a hydraulic means.

8. The device in claim 7 wherein said bead forming means includes bead forming members movable radially outwardly on said heads in response to said hydraulic means.

9. The device in claim 8 including a cone on said hydraulic means for moving said bead forming members.

10. The device claimed in claim 8 wherein said hydraulic means causes said bead forming members to move and is adjustable independently of said crank means and said drive means for said crank means, whereby said means for forming said beads may be adjusted independently of but with respect to the positioning and timing of said crank means.

11. The machine claimed in claim 10 wherein said crank means is adjustable.

12. The device claimed in claim 8 wherein said hydraulic means comprising a piston rod extending from opposite ends of said cylinder and there is an adjustable stop means for adjusting the piston rod thereby adjusting the bead forming members.

13. In a machine for forming a bead on a drum:

a machine frame, means for supporting a drum on said machine frame, said drum having open ends thereon, bead forming means comprising heads mounted on said machine for entering said open ends of said drum to engage the interior of said drum and to form spaced outwardly protruding beads circumferentially thereon, means for operating said bead forming means independent of other drive means on said machine, drive means for positioning and retracting said bead forming means within said drum, said drive means comprising crank means for each of said heads on said machine for driving said respective head in and out of said drum, said crank means being independent of said bead forming means and said means for operating said bead forming means, said drive means and said crank means being operated independent of said bead forming means, whereby said heads may be driven in a continuous harmonic motion without significant interruption of the stroke and whereby said bead forming means may be actuated independently of said crank means at the proper position to operate said bead forming means into the interior of said drum and to retract same without adversely affecting the stroke of said crank means, bead forming drive means independent of said drive means for said crank means, brake means for stopping said crank means and said drive means for said crank means to cause said heads to pause inside said drums, means for timing said crank means and said crank drive means to synchronize with said bead forming means so that said opposed heads pause inside said drums while said bead forming means form beads during which said bead forming means is operated independently of said crank means and crank drive means whereby said bead forming means is not driven by or from said crank drive means or said crank means.

14. The device in claim 13, said bead forming means comprising bead forming members to be positioned within said drum for movement on said heads to engage said drum to form beads thereon.

15. The device claimed in claim 13 wherein said means for operating said bead forming means is adjustable independently of said crank means and said drive means for said crank means, whereby said means for forming said beads may be adjusted independently of but with respect to the positioning and timing of said crank means.

16. The machine claimed in claim 13 wherein said crank means is adjustable.

17. The machine claimed in claim 13 wherein said bead forming means comprises a hydraulic cylinder and piston.

18. The machine claimed in claim 17 wherein said bead forming means comprises a cone driven by said hydraulic cylinder to expand and retract said bead forming members.

19. The device claimed in claim 17 wherein there is a hydraulic piston rod extending from opposite ends of said cylinder and there is an adjustable stop means for adjusting the piston rod thereby adjusting the bead forming members.

20. A method of forming a bead on a drum comprising:

engaging said drum by bead forming means comprising bead forming members carried by respective heads and causing said members to move against said drum to form a bead and to move away from the drum after forming said bead, providing a bead forming drive means for causing said bead forming members to engage said drum, driving said bead forming members into the interior of and out of said drum by a mechanical drive means comprising crank means separate from said bead forming means, stopping said mechanical drive means inside said drum by braking said mechanical drive means to cause said heads to pause inside said drum, timing said crank means and said drive means and synchronizing same with said bead forming means, causing said opposed heads to pause inside said drums while said bead forming means form beads during which said bead forming means is operated independently of said crank means and drive means whereby said bead forming means is not driven by said crank means or said drive means, driving said bead forming means separately and independent from said drive means for said heads.

21. The method in claim 20 including operating said bead forming means hydraulically operated.

22. The method claimed in claim 20 including providing said mechanical drive means with a gear and a connecting rod attached thereto.

23. The method claimed in claim 1 including providing said crank means with a crank arm and said connecting rod being attached to said crank arm.

24. The method claimed in claim 23 including supporting said bead forming members on separate, independent heads movable toward and away from each other to enter said drum and exit therefrom.

25. The method claimed in claim 21 including providing said bead forming means with a hydraulic cylinder and piston.

26. The method in claim 25 including providing adjustment for said bead forming means independently of said mechanical drive means whereby said bead forming means may be adjusted independently of but with respect to the positioning and timing of the mechanical drive means.

27. The method claimed in claim 21 including providing a hydraulic cylinder and piston for said bead forming means and adjustment means therefor.

28. The method claimed in claim 27 including providing said hydraulic cylinder with a piston rod extending from opposite ends of the cylinder and an adjustable stop means for adjusting the piston rod.

* * * * *